US005193841A

United States Patent [19]

Stritzl et al.

[11] Patent Number: 5,193,841

[45] Date of Patent: * Mar. 16, 1993

[54] BEARING PART SUPPORT FOR TOGGLE LEVERS OF A FRONT JAW

[75] Inventors: Karl Stritzl, Vienna; Andreas Janisch, Oeyenhausen; Hubert Wuerthner, Hainburg/Donau, all of Austria

[73] Assignee: HTM Sport- und Freizeitgeraete Gesellschaft m.b.H., Schwechat, Austria

[ * ] Notice: The portion of the term of this patent subsequent to Jul. 23, 2008 has been disclaimed.

[21] Appl. No.: 556,845

[22] Filed: Jul. 23, 1990

[30] Foreign Application Priority Data

Jul. 21, 1989 [AU] Australia ..... 1762/89
Dec. 11, 1989 [AU] Australia ..... 2790/89

[51] Int. Cl.[5] ..... A63C 9/08
[52] U.S. Cl. ..... 280/625; 280/628
[58] Field of Search ..... 280/623, 625, 626, 628, 280/629, 631, 634, 633, 630

[56] References Cited

U.S. PATENT DOCUMENTS 3,902,730 9/1975 Tschida et al. ..... 280/625
3,950,002 4/1976 Schweizer et al. ..... 280/625
4,170,371 10/1979 Weigl et al. ..... 280/625
4,290,624 9/1981 Storandt ..... 280/634
4,345,776 8/1982 Salomon ..... 280/629
4,431,210 2/1984 Nitschko ..... 280/625
4,434,997 3/1984 Nitschko ..... 280/625
4,449,730 5/1984 Oberleitner et al. ..... 280/625
4,765,641 8/1988 Peyre ..... 280/628
4,902,031 2/1990 Bogner ..... 280/625
4,974,869 12/1990 Muhlberger et al. ..... 280/625
4,989,893 2/1991 Kowatsch et al. ..... 280/625
5,033,768 7/1991 Stritzl ..... 280/625

FOREIGN PATENT DOCUMENTS 2448769 4/1976 Fed. Rep. of Germany .

*Primary Examiner*—Brian Johnson
*Attorney, Agent, or Firm*—Flynn, Thiel, Boutell & Tanis

[57] ABSTRACT

A front jaw having a housing receiving a release spring therein, through which housing extends a pull rod acting onto two toggle levers. In order to improve the release operation in such a front jaw, the invention provides that the housing has two bearing surfaces designated for a bearing part, which bearing surfaces are vertically spaced from the pull rod, and that the axles of the two toggle levers are arranged in the bearing part which rests in the skiing position under the influence of the release spring on the two bearing surfaces.

21 Claims, 13 Drawing Sheets

BEARING PART SUPPORT FOR TOGGLE LEVERS OF A FRONT JAW

FIELD OF THE INVENTION

The invention relates to a front jaw having structure for automatically accommodating ski boots with differing sole thicknesses.

BACKGROUND OF THE INVENTION

A conventional front jaw is already described in AT-PS 321 170 (which corresponds to U.S. Pat. No. 3,902,730). Each toggle lever in this front jaw grips only the lateral edge of the sole of the boot. To hold the sole of the boot from above, an additional sole down-holding means is provided which must be adjusted manually in its elevational position for soles of boots having differing thicknesses. Consequently, such a handling of the front jaw is time consuming.

In the front jaw according to DE-OS 24 48 769, the housing receiving the release spring has a backside on which, in the skiing position, is supported a sole holder which is approximately circular in the top view and provides a three-point contact. The sole holder is thereby urged against the backside of the housing by a pull rod loaded by the release spring. The front jaw can be released both during a pure twisting fall and also during a backward fall and also during a backward twisting fall of the skier. The necessary release force can be changed by adjusting the initial tension of the release spring and by shifting the upper support point of the sole holder on the backside of the housing.

The aforesaid front jaw has the disadvantage that it can only be used for soles of boots having exact dimensions, since its sole holder cannot be adjusted to deviating dimensions in the thickness and in the peripheral surface of the sole of the boot.

The front jaw according to the first embodiment of DE-OS 30 20 346 (which corresponds to U.S. Pat. No. 4,345,776) (compare FIGS. 1–7) has a ski-fixed housing in which a release spring with an adjustable initial tension is housed. A pull rod extends through the spring, which pull rod terminates in a bearing eye at its end facing the ski boot. A connecting piece is stored in the bearing eye. An adjusting screw extends through the connecting piece. The two ends of the adjusting screw are supported in a sole down-holding means which, when viewed in the top view, consists of a center part extending in transverse direction with respect to the front jaw and of two legs connected to the part each at an angle. The center part is pulled toward the projecting edge of the housing by the release spring such that a three-point contact exists.

In another embodiment (compare FIGS. 8–13 of DE-OS 30 20 346), a peg is vertically fastened on the ski, on which peg is supported a housing for a release spring, which housing carries a sole down-holding means. A three-point contact exists also in this case, namely, of the housing on the peg.

The sole down-holding means can in both embodiments not only pivot in a plane parallel with respect to the upper side of the ski, but a lifting of the sole down-holding means is also possible during a backward fall of the skier. Of course, the sole down-holding means is designed as a rigid member which cannot adjust to the shape of any kind of a sole of a boot.

The front jaw according to AT-PS 315 698 (which corresponds to U.S. Pat. No. 3,950,002) does not have this disadvantage. A pull rod loaded by a pressure spring is housed in a ski-fixed housing in a first embodiment (see FIGS. 1–3). A piston equipped with an annular groove is fastened to the pull rod. The base of the housing is extended toward the ski boot and carries two vertical swivel axes on which rocking levers are supported, the longer lever arms of which rest on the sole of the boot. The shorter lever arms of the two swivel levers engage the annular groove of the piston.

A type of pivot pin engaging bore is provided in the shorter lever arm of each of the two rocking, which shorter lever arm rests in a second embodiment (see FIGS. 4 and 5) on the pull rod loaded by a tension spring.

The front jaw enables, in both embodiments, a good fastening of differently constructed soles of boots on the ski. A release of the ski boot, however, does not take place during a backward fall of the skier.

SUMMARY OF THE INVENTION

The purpose of the invention is to overcome the disadvantages of all known embodiments and to provide a front jaw which, on the one hand, automatically adjusts to differently dimensioned soles of boots and which, on the other hand, enables a release of the ski boot of the skier both during a pure twisting fall, and also during a backward fall and also during a backward twisting fall.

A front jaw having a housing receiving a release spring therein, through which housing extends a pull rod acting onto two toggle levers. In order to improve the release operation in such a front jaw, the invention provides that the housing has two bearing surfaces designated for a bearing part, which bearing surfaces are vertically spaced from the pull rod, and that the axles of the two toggle levers are arranged in the bearing part which rests in the skiing position under the influence of the release spring on the two bearing surfaces.

BRIEF DESCRIPTION OF THE DRAWINGS

The drawings illustrate exemplary embodiments of the front jaws of the invention, in which.

Figure 22:
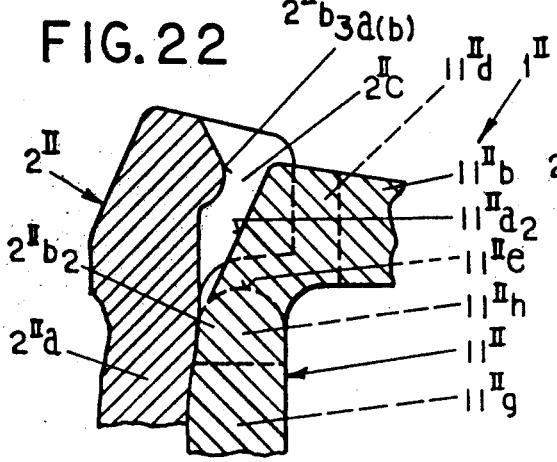
FIG. 22 is an enlarged cross-sectional view in part taken along the line XXII—XXII of FIG. 16 of a further detail with a front jaw which is in the rest position.

(Note, FIGS. 22a–25c refer to the detail as shown in FIG. 22).

Figure 22A:
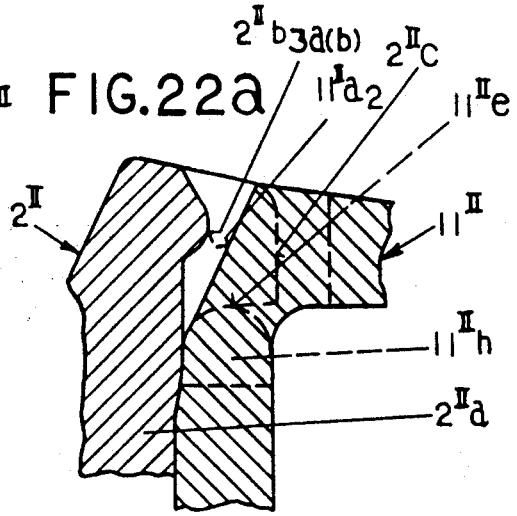
Figure 22B:
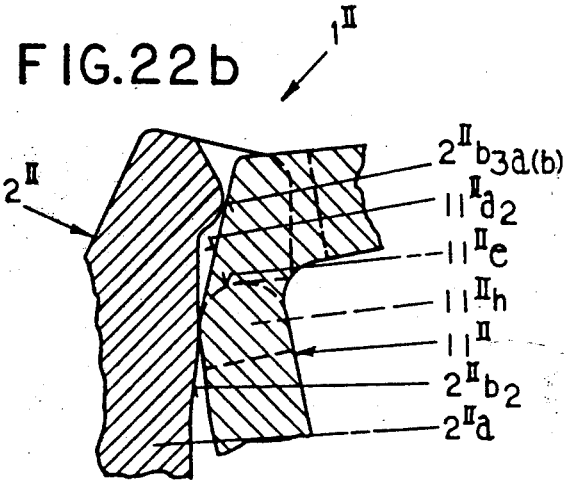
Figure 22C:
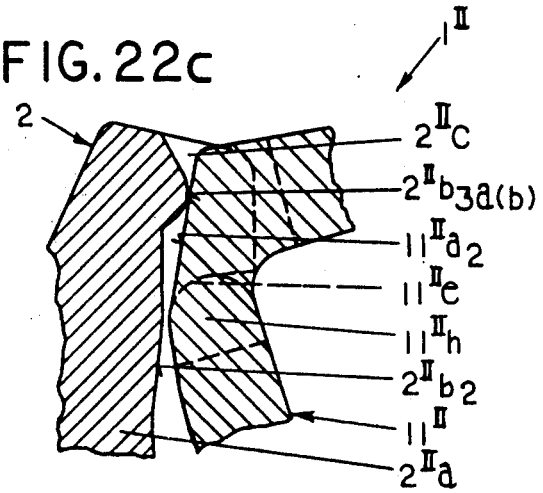
Figure 23A:
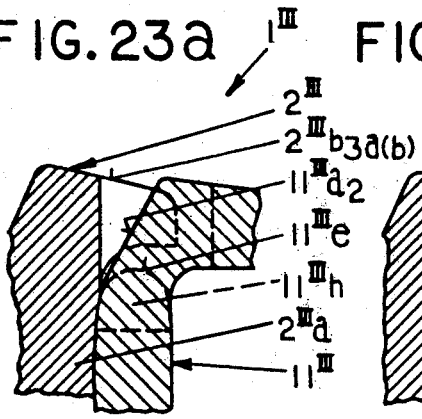
Figure 23B:
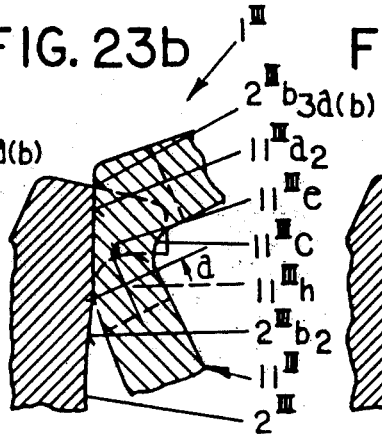
Figure 23C:
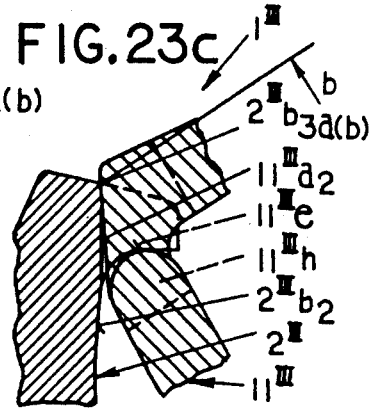
Figure 24A:
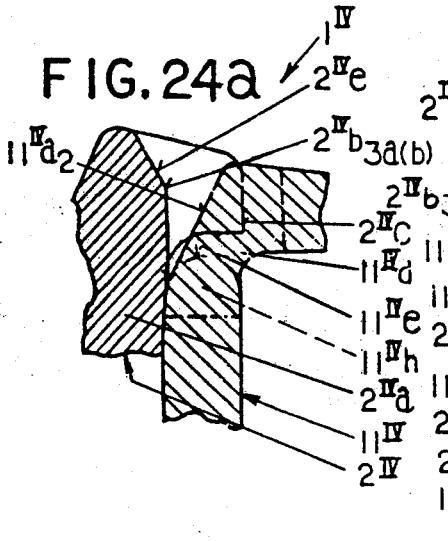
Figure 24B:
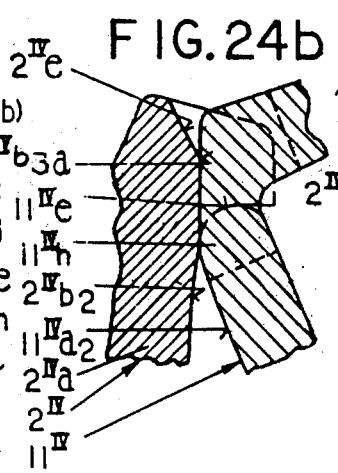
Figure 24C:
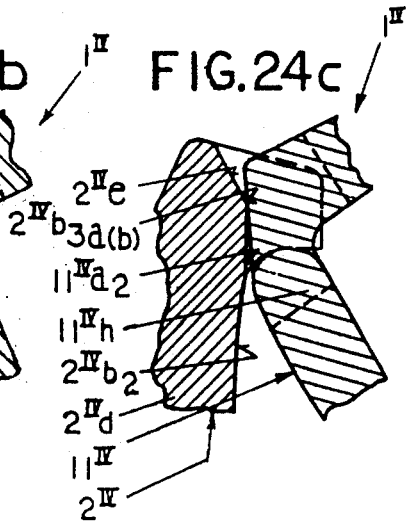
Figure 25A:
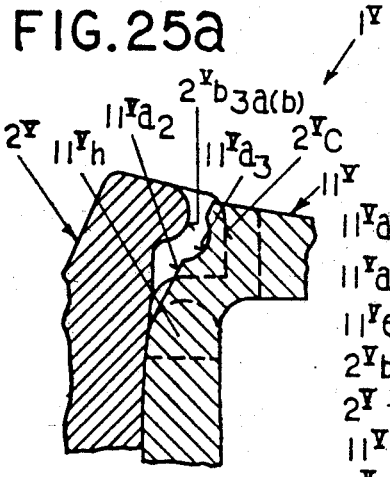
Figure 25B:
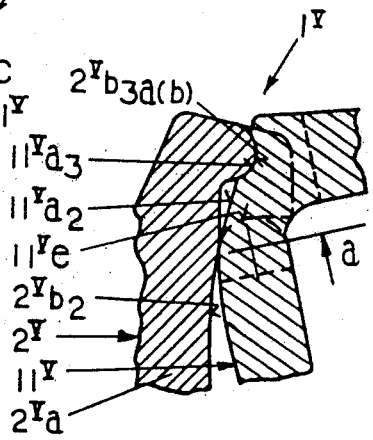
Figure 25C:
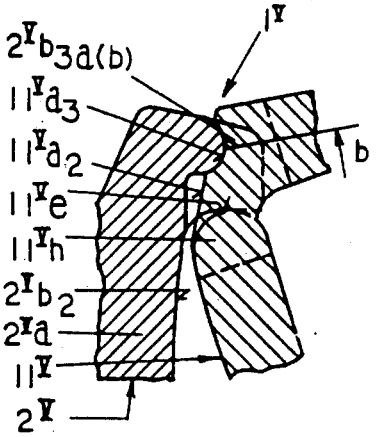

FIG. 22a shows the same detail when a ski boot with the greatest possible sole thickness is inserted or at the start of a backward fall with a low sole of the boot;

FIG. 22b shows the same detail at the end of the first phase of a backward fall;

FIG. 22c shows this detail during the second phase of the backward fall;

FIG. 23a illustrates the mentioned detail in a fourth embodiment of a front jaw which is in the rest position;

FIG. 23b shows the same detail at the end of the first phase of a backward fall;

FIG. 23c shows this detail at the start of the second phase of a backward fall;

FIG. 24a illustrates the mentioned detail in a fifth embodiment of a front jaw which is in the rest position;

FIG. 24b shows the same detail at the end of the first phase of a backward fall;

FIG. 24c shows the same detail at the start of the second phase during a backward fall;

FIG. 25a shows the detail being discussed here in a sixth embodiment of a front jaw which is in the rest position;

FIG. 25b shows the same detail during the first phase of a backward fall;

FIG. 25c shows the same detail during the second phase of a backward fall; and

Figure 26:
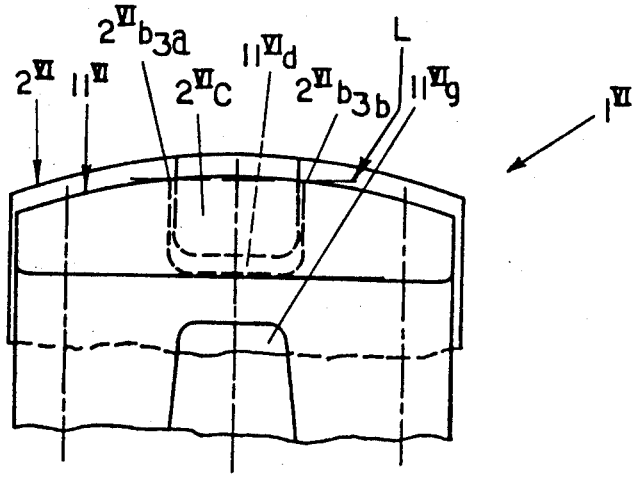

FIG. 26 is a partially broken away view in axial direction of the pull rod of a seventh embodiment of a front jaw.

DETAILED DESCRIPTION

FIGS. 1–13 identify the front jaw in its entirety by the reference numeral 1. The front jaw has a housing 2 which is fastened on the upper side 3a of a ski by means of screws 3b (only schematically indicated). A release spring 4, constructed as a helical spring, is housed in the housing 2, the initial tension of which release spring can be adjusted in a conventional manner by a threaded sleeve 5. The release spring 4 is arranged between a spring plate 6 and a bearing sleeve 7 housed in a vertical crosswall 2a of the housing 2. A pull rod 8 extends in axial direction through the release spring 4. The threaded sleeve 5 is screwed onto the one end 8a of the pull rod 8 and the other end 8b of the pull rod 8 is riveted to the vertical leg 9a of an angular slide member 9, which with its other leg 9b is guided in the housing 2. A vertically extending beam 10 sits behind the leg 9a on the pull rod 8, which vertical beam is formed by a profiled steel-plate strip and the function of which will be described in detail later.

Two vertically spaced bearing surfaces $2b_1$ and $2b_2$ (see FIG. 6) are provided on the backside of the vertical crosswall 2a and at vertical distances from the pull rod 8, which bearing surfaces each define a rearwardly open acute angle $\alpha$ and $\beta$ (see FIG. 12) with the upper side 3a of the ski. The lower angle $\alpha$ is thereby smaller than the upper angle $\beta$. A bearing part 11 with corresponding countersurfaces $11a_1$ and $11a_2$ rests on the two bearing surfaces $2b_1$ and $2b_2$ in the rest position of the front jaw 1 (without ski boot). Furthermore, the bearing part 11 rests in this position also on the vertical crosswall 2a of the housing 2. This bearing part 11 is frame-shaped viewed from behind, namely it has a through opening 11g for the pull rod 8, and has, viewed in the side view, approximately the shape of a C (compare FIG. 11). The upper leg of the C is formed by a continuous, transversely extending plate 11b, whereas the lower leg consists of two tongues $11c_1$ and $11c_2$ arranged symmetrically in relationship to the central vertical longitudinal cross-sectional plane of the front jaw 1. An axle 12a, 12b is arranged between the plate 11b and each of the tongues $11c_1$ and $11c_2$, on each of which axles is supported a toggle lever 13 or 14. The longer lever arm 13a, 14a of each toggle lever 13, 14 has a substantially U-shaped cross section with axles 15–18 being arranged in the two legs thereof, which axles support rollers 19–22. The upper legs of the longer lever arms 13a, 14a are thereby supported on the upper side of the sole of the boot. The shorter lever arms 13b, 14b of the two toggle levers 13, 14 are supported in a conventional manner on the vertical beam 10 fastened on the pull rod 8.

The crosswall 2a of the housing 2 has, following the upper bearing surface $2b_2$, a rectangularly shaped, in the top view, rearwardly, approximately horizontally extending, projection 2c which is received with clearance into a recess 11d of the bearing part 11. The upwardly facing boundary surface 11e of the bearing part 11, which surface lies below the recess 11d, is, when the ski boot is not inserted, spaced some millimeters from the projection 2c. If, however, a ski boot is inserted into the front jaw 1, then the bearing part 11 moves slightly upwardly in dependency of the thickness of the sole of the ski boot. Because of the difference between the two angles $\alpha$ and $\beta$, the bearing part 11 experiences in addition to the upward movement at the same time also a pivoting movement through a small angle $\phi$. A mechanical adjustment of the elevational position of the two toggle levers 13, 14 to the different thickness of the soles of the ski boot is thereby not necessary, because their elevational adjustment occurs automatically.

The lower bearing surface $2b_1$ is interrupted in its center area by a lower projection 2d, the boundary line of which, viewed in the top view, is formed by a rectangle and by an isosceles triangle. A recess 11f in the bearing part 11 is associated with the projection 2d constructed like a wedge. The recess 11*f* is adapted to the contour of the projection 2*d* (see FIG. 1*a*).

In the skiing position of the front jaw 1 (with the ski boot inserted), the vertical beam 10 rests in its lower area directly on the bearing part 11. The longer lever arms 13*a*, 14*a* of the two toggle levers 13, 14 are thereby urged against the sole of the boot through their shorter lever arms 13*b*, 14*b*.

Figure 1:
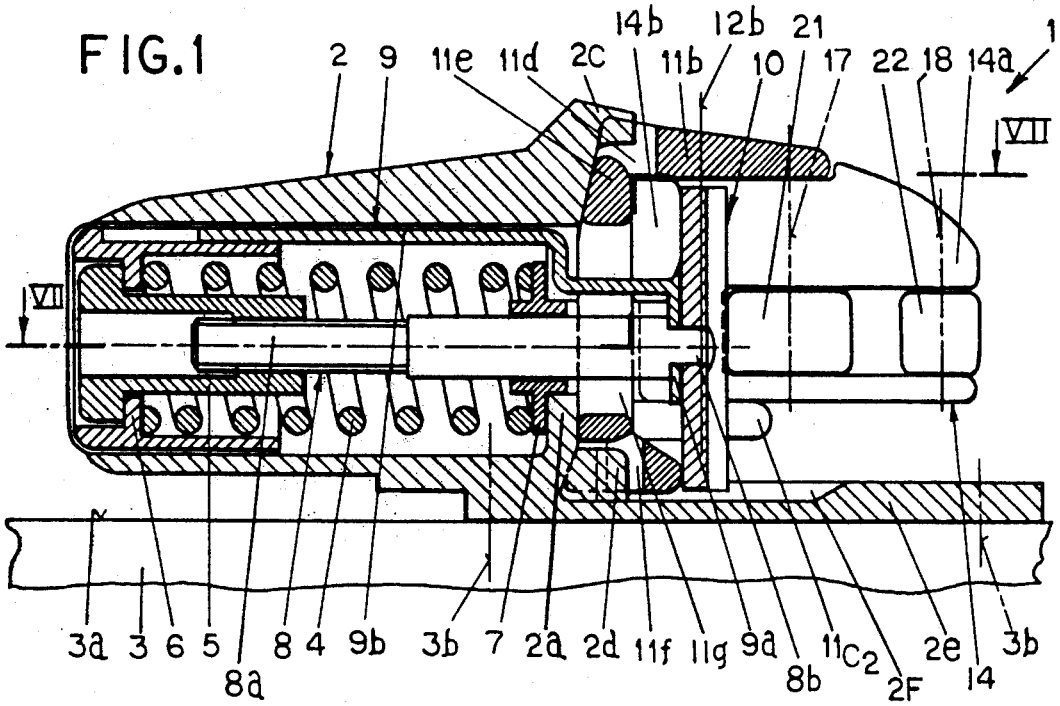
FIG. 1 is a central, vertical longitudinal cross-sectional view of a front jaw in the skiing position.
Figure 2:
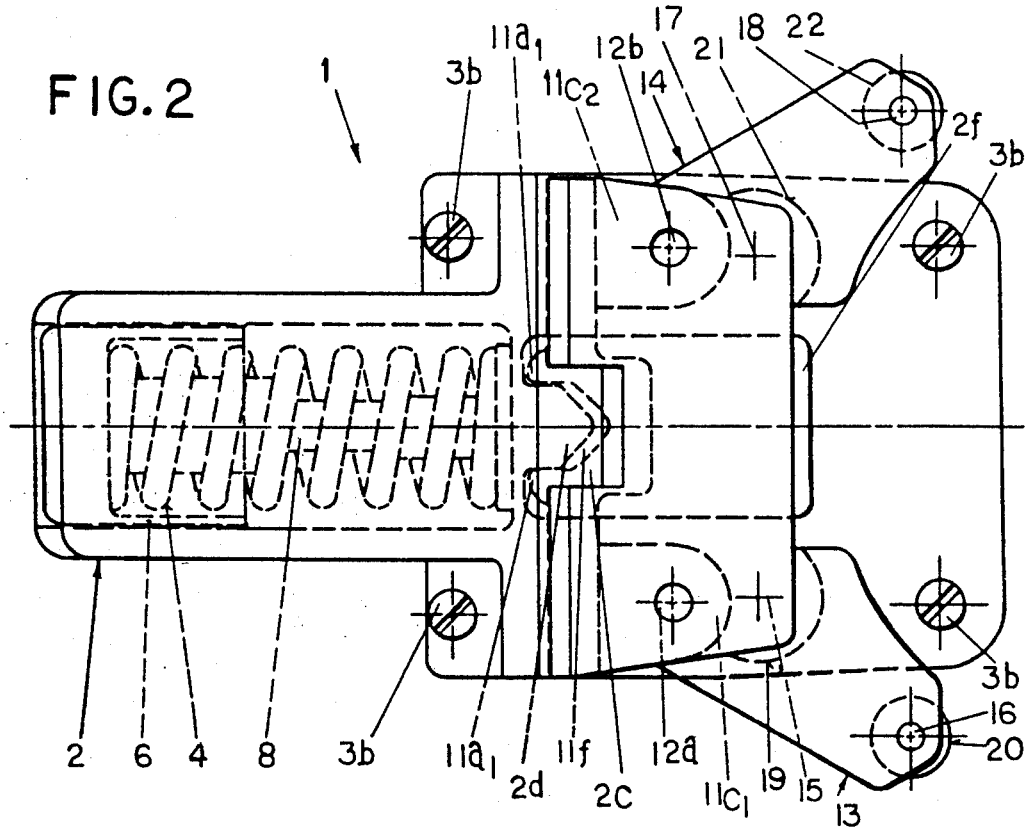
FIG. 2 is a top view thereof.

If a backward fall of the skier occurs during skiing, then the bearing part 11 is pivoted counterclockwise in FIG. 1. The release spring 4 is thereby more strongly initially tensioned, and the bearing part 11 is lifted compared to the skiing position until the upper boundary surface 11*e* lies in the cavity between the projection 2*c* and the upper bearing surface $2b_2$ (first phase, see FIG. 4). The lower countersurface $11a_1$ of the bearing part 11 is thereafter lifted off from the bearing surface $2b_1$ of the housing 2, however, the bearing part 11 is still guided on the lower projection 2*d* of the housing 2 (second phase, see FIGS. 5 and 5*a*).

Figure 5:
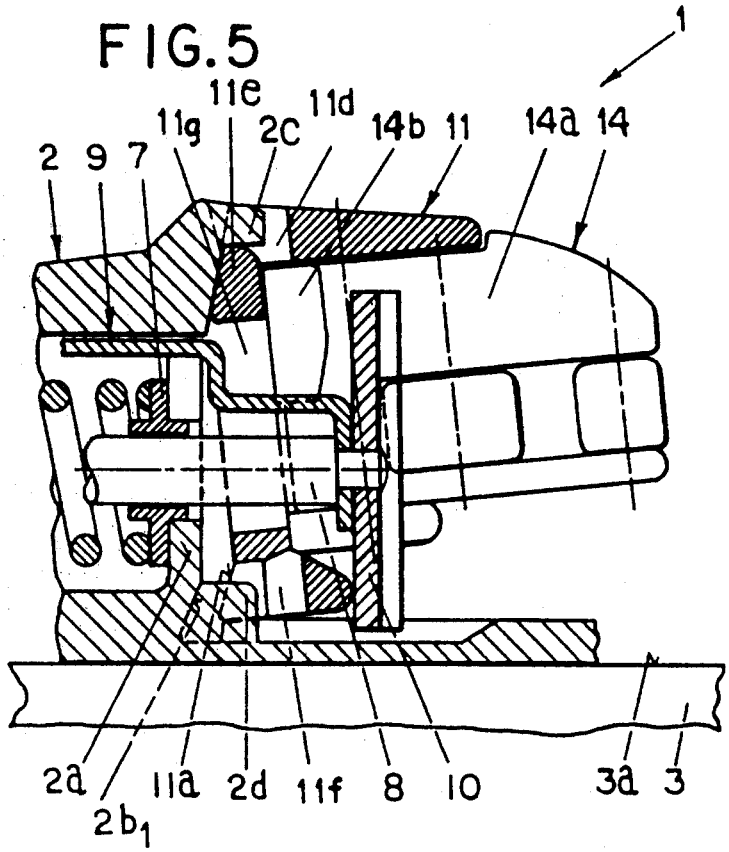
FIG. 5 illustrates a detail of the front jaw in a central, vertical longitudinal cross-sectional view during a backward fall of the skier.
Figure 5A:
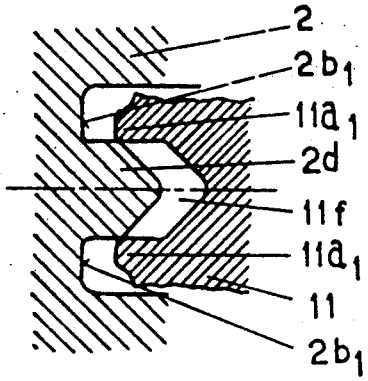

If, however, a backward twisting fall of the skier occurs during skiing, then the bearing part 11 is first pivoted counterclockwise in the afore-described manner until the position shown in FIG. 5*a* is exceeded. The bearing part 11 is thereafter rotated in a plane that is transverse to the longitudinal axis of the ski. This is made possible by the through opening 11*g* having ample clearance with respect to the pull rod 8. The upper area of the bearing part 11 is, during this rotation, held by the upper projection 2*c* of the housing 2, which projection is received with play in the recess 11*d*. The recess 11*f* in the lower area of the bearing part 11 is lifted off from the lower projection 2*d* of the housing 2, after which the bearing part 11 can rotate transversely with respect to the longitudinal axis of the ski 3 (third phase, see FIGS. 6 and 6*a*). The vertical beam 10 thereby releases the shorter lever arms 13*b*, 14*b* of the two toggle levers 13, 14, which makes it easier for the skier to step with his ski boot out of the front jaw 1 (see FIGS. 6, 8 and 10).

Figure 1A:
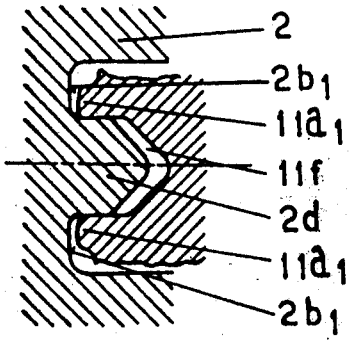
FIGS. 1*a*, 5*a* and 6*a* are cross-sectional views showing, respectively, the bearing part in the skiing position, in the position during a backward fall and in the position during a backward twisting fall.
Figure 6:
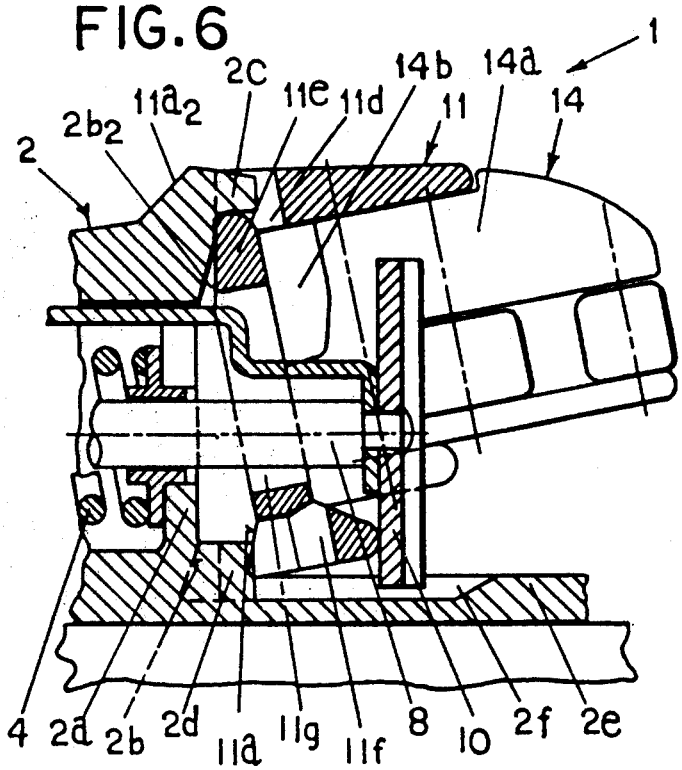
FIG. 6 shows the same detail when in addition also a twisting fall occurs.
Figure 6A:
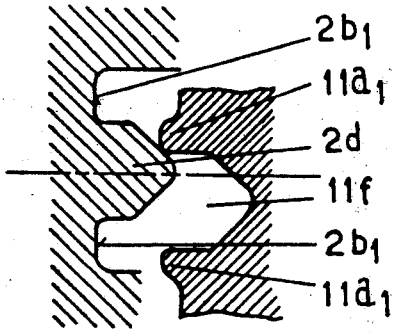
Figure 3:
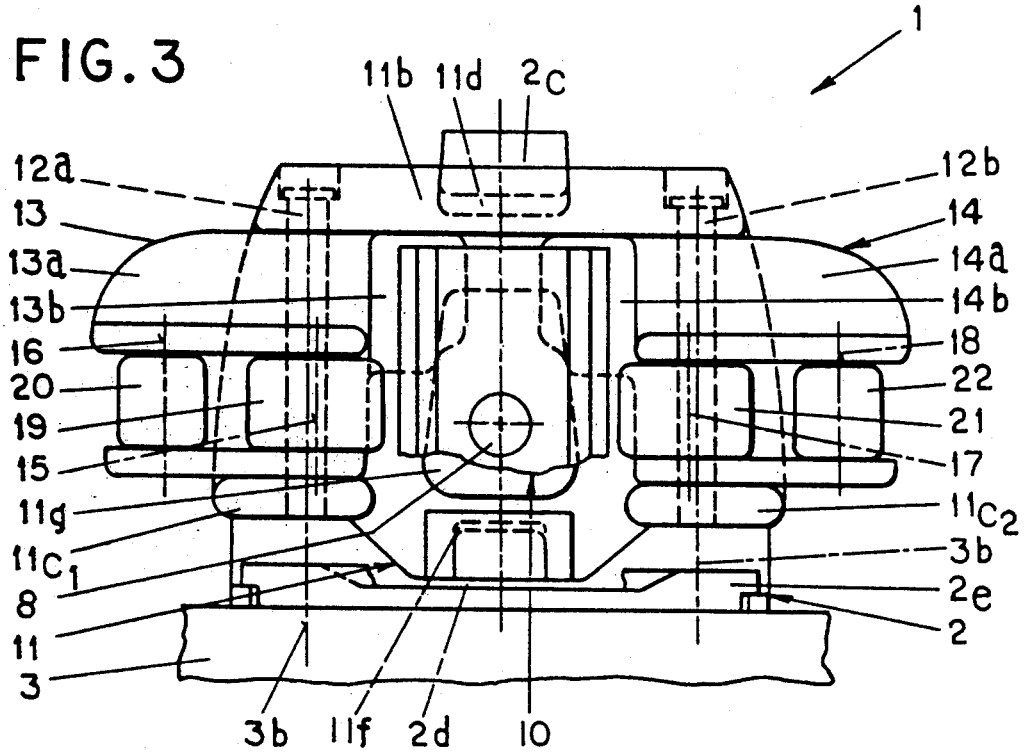
FIG. 3 is a front view thereof.
Figure 4:
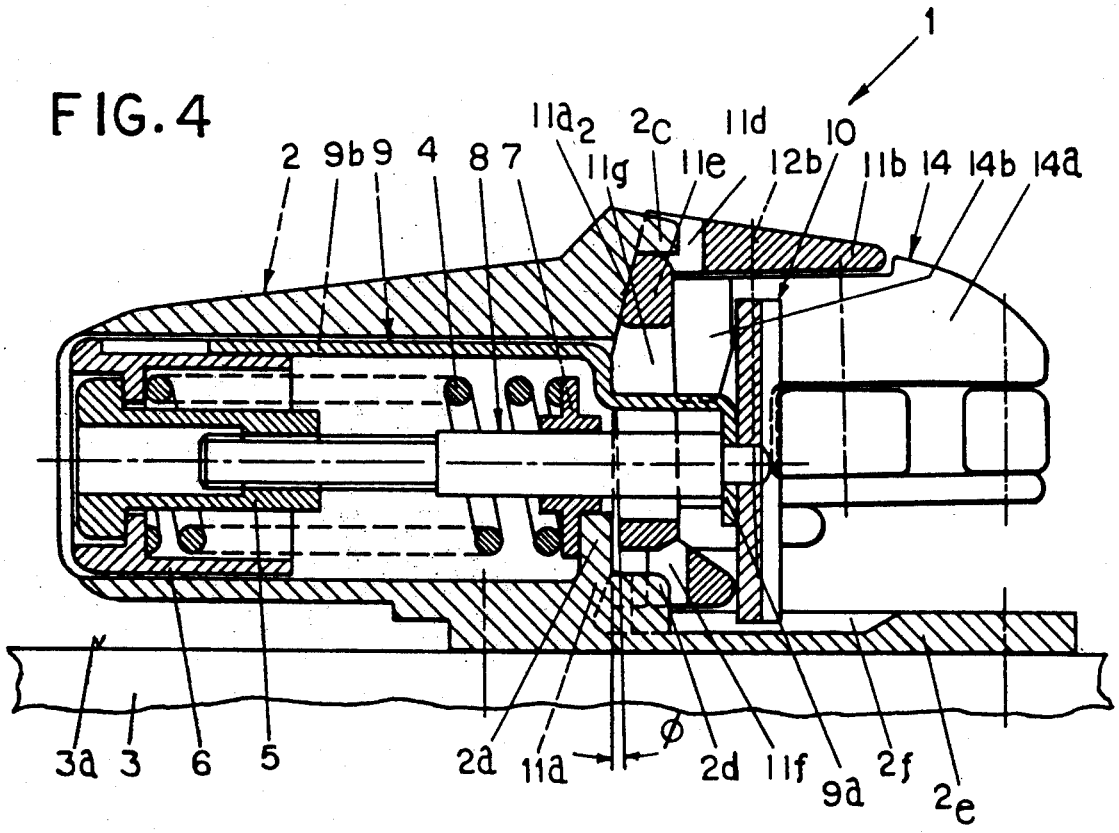
FIG. 4 is a central, vertical longitudinal cross-sectional view of the front jaw in the first phase of a backward fall.
Figure 7:
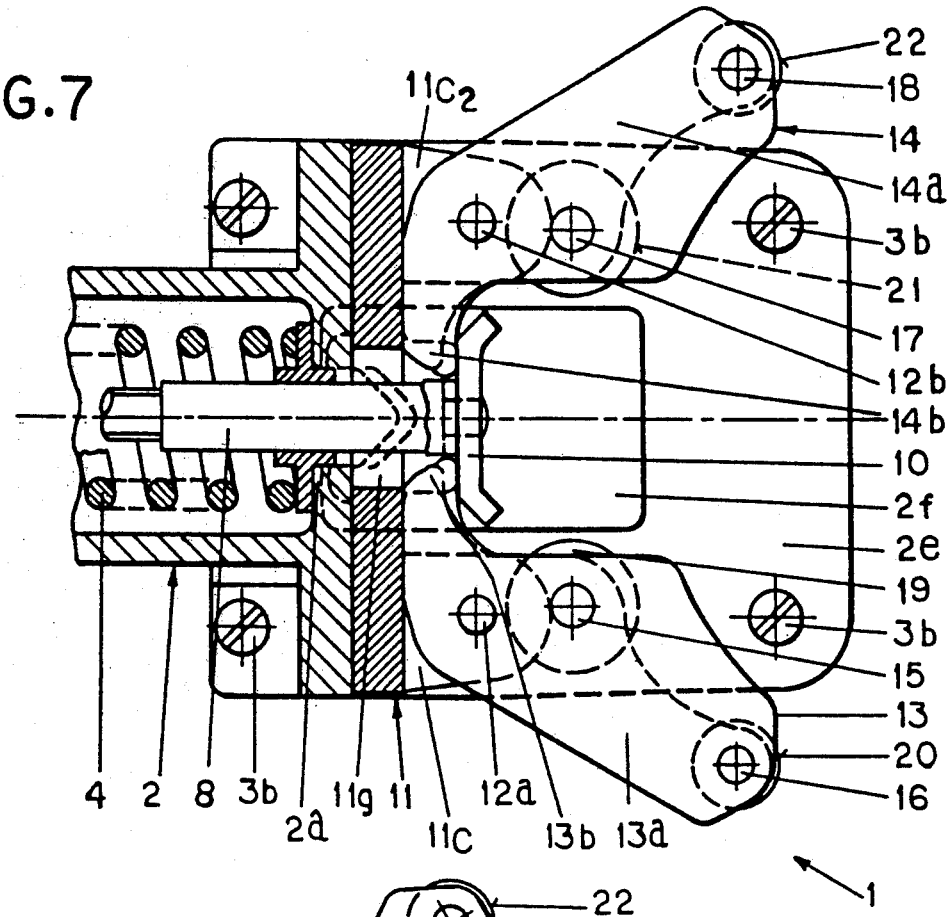
FIG. 7 is a cross-sectional view taken along the line VII—VII of FIG. 1.
Figure 8:
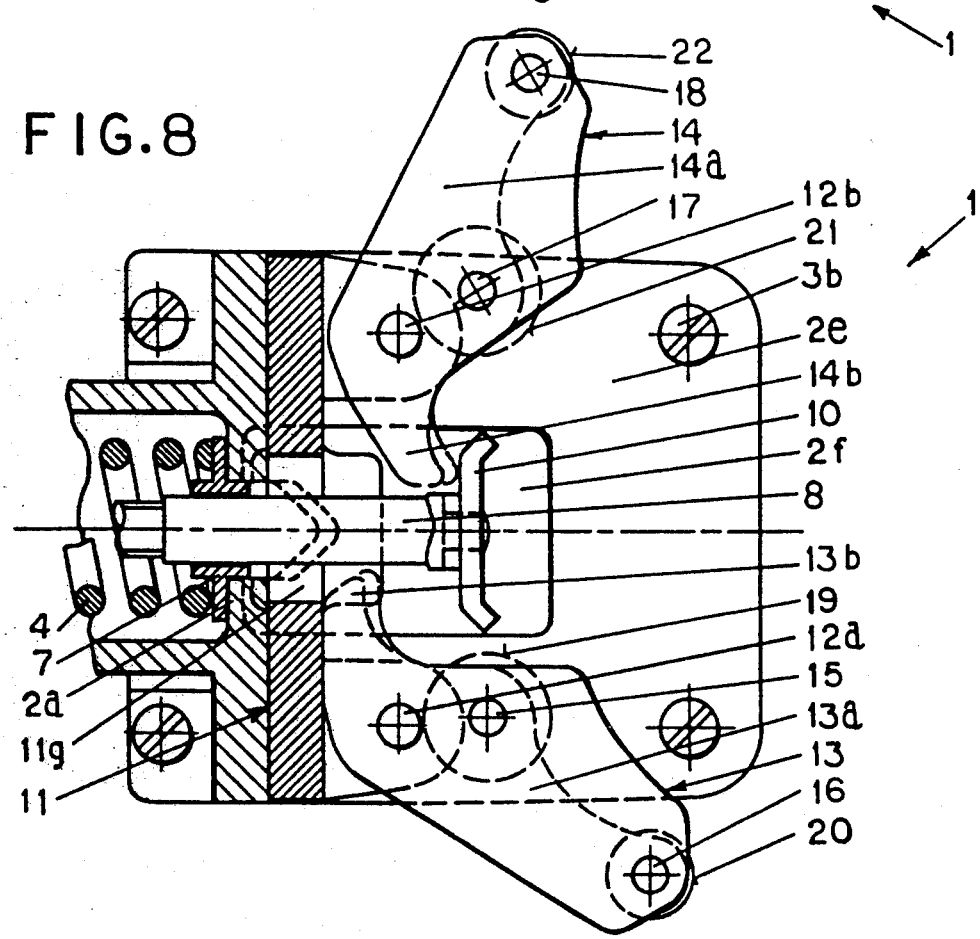
FIG. 8 is the same cross-sectional view with a front jaw which, due to a twisting fall, releases laterally.
Figure 9:
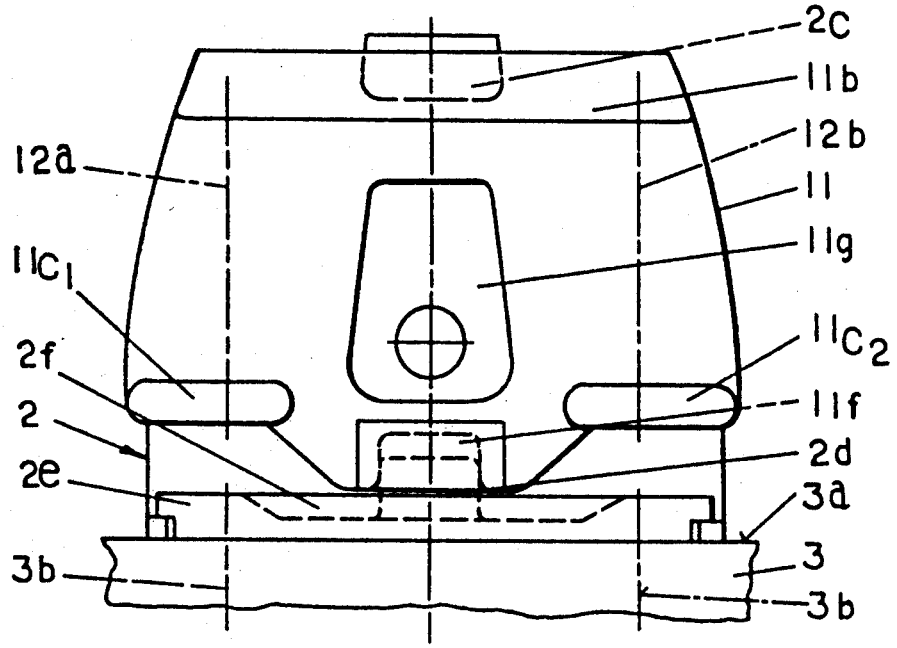
FIG. 9 is a simplified front view of the front jaw during a backward fall, the toggle levers not being shown for the sake of clarity.
Figure 10:
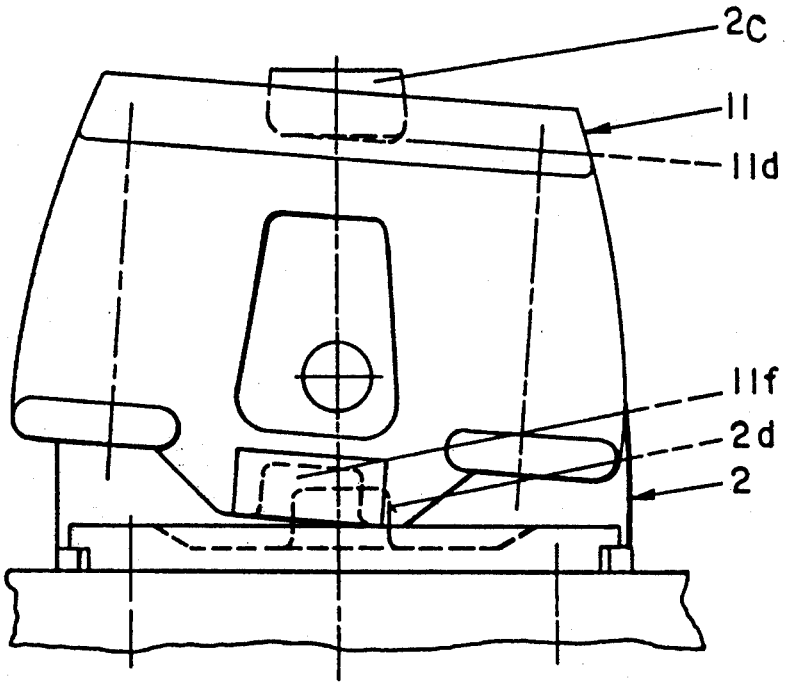
FIG. 10 is an analogous illustration of the front jaw during a backward twisting fall.
Figure 11:
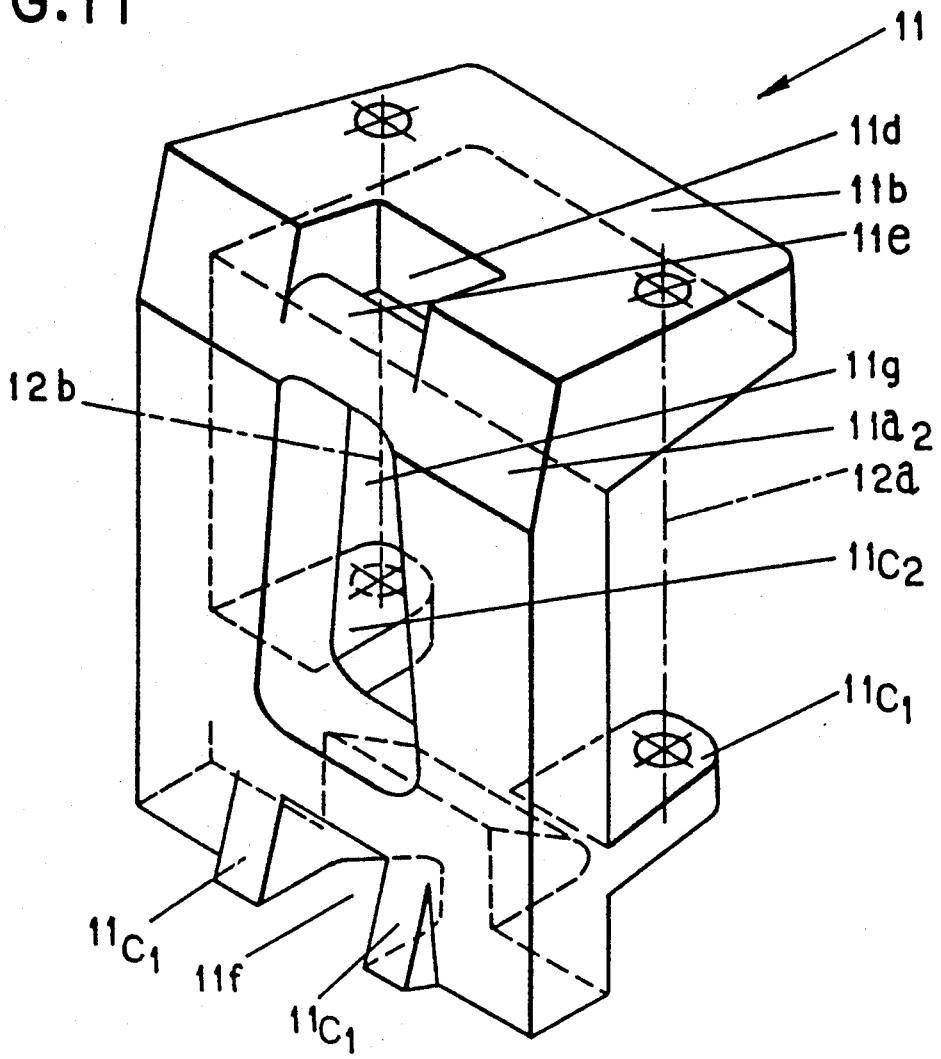
FIG. 11 is a perspective view of the bearing part.

The return of the bearing part 11 into the skiing position or into the stepping-in position is achieved by the wedge-like construction of the front side of the lower projection 2*d* of the housing 2, on which wedge is supported the boundary edge of the recess 11*f* in the bearing part 11 (see FIG. 6*a*). The bearing part 11 is thereby pulled by the release spring 4 in a direction toward the bearing surface $2b_1$ of the housing 2 until the position illustrated in FIG. 1*a* is reached.

Figure 14:
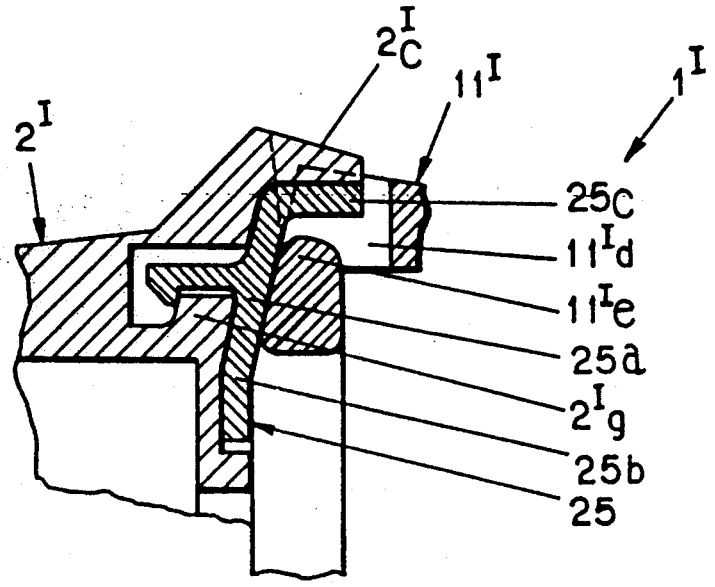
FIG. 14 is a central, vertical longitudinal cross-sectional view of a modified second embodiment of a part of the housing similar to FIG. 1.
Figure 12:
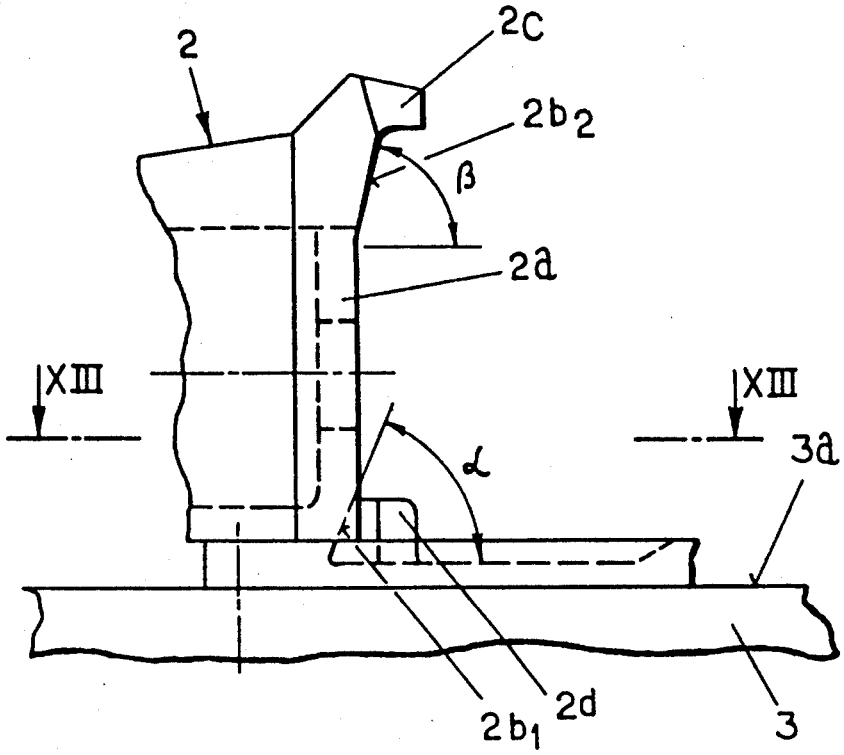
FIG. 12 shows a side view of a portion of the housing.
Figure 13:
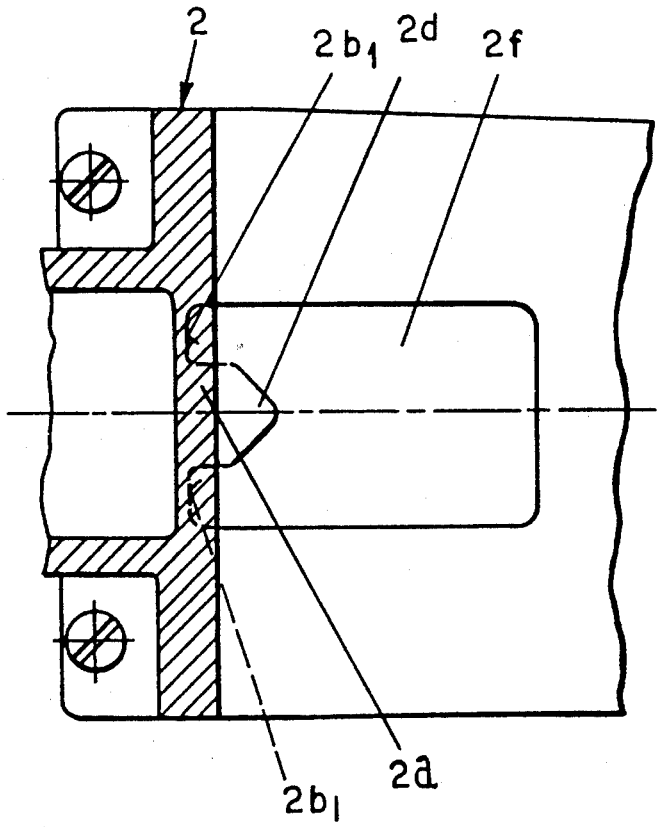
FIG. 13 is an associated cross-sectional view taken along the line XIII—XIII of FIG. 12.

The front jaw $1^I$ according to FIG. 14 differs from the first described front jaw 1 by arranging an intermediate piece 25 between the metal housing $2^I$ and the metal bearing part $11^I$, which intermediate piece is manufactured of a low-friction, however, nondeformable material, for example of DELRIN, which reduces the friction. The intermediate piece 25 has a hook 25*a* which can be held on a rib $2^Ig$ of the housing $2^I$. The intermediate piece 25 rests furthermore with the bent section 25*c* of its front side 25*b* on the upper projection $2^Ic$ of the housing $2^I$. The shape of the front side 25*b* of the intermediate piece 25 corresponds moreover with the shape of the upper bearing surface $2b_2$ or of the crosswall 2*a* of the housing 2 of the first exemplary embodiment.

FIGS. 15 to 22*c* show a third embodiment of a front jaw $1^{II}$. The front jaw $1^{II}$ has a housing $2^{II}$ which is fastened on the upper side $3^{II}a$ of a ski $3^{II}$ by means of screws $3^{II}b$ (only schematically indicated). A release spring $4^{II}$ constructed as a helical spring is housed in the housing $2^{II}$, the initial tension of which release spring can be adjusted in a conventional manner by a threaded sleeve $5^{II}$. The release spring $4^{II}$ is arranged between a spring plate $6^{II}$ and a bearing sleeve $7^{II}$ supported in a vertical crosswall $2^{II}a$ of the housing $2^{II}$. A pull rod $8^{II}$ extends in axial direction through the release spring $4^{II}$. The threaded sleeve $5^{II}$ is screwed onto the one end $8^{II}a$ of the pull rod and the other end $8^{II}b$ of the pull rod is fixedly connected to the vertical leg $9^{II}a$ of an angular slide member $9^{II}$ guided with its other horizontal leg $9^{II}b$ in the housing $2^{II}$. A vertical beam $10^{II}$ formed by a profiled steel-plate strip sits behind the leg $9^{II}a$ on the pull rod $8^{II}$. The function of the beam will yet be described in detail. Three support areas each arranged at vertical distances from one another exist on the backside of the vertical crosswall $2^{II}a$. These support areas are constructed as bearing surfaces in the third embodiment, namely one lower $2^{II}b_1$, one upper $2^{II}b_2$ and one third $2^{II}b_3$. The lower bearing surface $2^{II}b_1$ extends thereby below the pull rod $8^{II}$, whereas the two other bearing surfaces $2^{II}b_2$ and $2^{II}b_3$ are above the pull rod $8^{II}$. The bearing surfaces $2^{II}b_1$ and $2^{II}b_2$ are formed by flat surfaces which define angles $\alpha$ or $\beta$ (see FIG. 20) with the horizontal plane. The lower bearing surface $2^{II}b_1$ is thereby divided into two sections $2^{II}b_{1a}$ and $2^{II}b_{1b}$. Whereas the third bearing surface $2^{II}b_3$, viewed in cross section, is curved approximately semicircularly. This bearing surface $2^{II}b_3$ projects furthermore rearwardly through the ideal vertical plane placed through the centerlines of the two other bearing surfaces $2^{II}b_1$ and $2^{II}b_2$. Furthermore, the third bearing surface $2^{II}b_3$, just like the lower one $2^{II}b_1$, is not continuous, but consists of two sections $2^{II}b_{3a}$ and $2^{II}b_{3b}$ separated from one another by an approximately horizontal projection $2^{II}c$ which is approximately rectangular in the top view.

A bearing part $11^{II}$ rests with corresponding countersurfaces $11^{II}a_1$ and $11^{II}a_2$ on the two bearing surfaces $2^{II}b_1$ and $2^{II}b_2$ in the rest or in the skiing position of the front jaw $1^{II}$. The upper area of the countersurface $11^{II}a_2$ is associated with the third bearing surface $2^{II}b_3$, which countersurface defines an angle $\delta$ with a transverse vertical plane. Furthermore, the bearing part $11^{II}$ rests in the rest position (when the ski boot is not inserted) also on the vertical crosswall $2^{II}a$ of the housing $2^{II}$. The bearing part $11^{II}$ has in its upper area an upper recess $11^{II}d$ into which extends with clearance an upper projection $2^{II}c$ of the housing $2^{II}$. The lower bearing surface $2^{II}b_1$ is in its center area interrupted by a lower projection $2^{II}d$ and is divided into the sections $2^{II}b_{1a}$ and $2^{II}b_{1b}$. A recess $11^{II}f$ in the bearing part $11^{II}$ is associated with the lower projection $2^{II}d$, which recess corresponds with the projection $2^{II}d$.

The bearing part $11^{II}$ is frame-shaped, viewed from the rear, namely it has a through opening $11^{II}g$ for the pull rod $8^{II}$, which through opening is closed off at its upper side by a web $11^{II}h$ with an upper boundary surface $11^{II}e$. The bearing part $11^{II}$ has, viewed in the side view, approximately the shape of a C (compare FIG. 21). The upper leg of the C is formed by a plate $11^{II}b$ continuous in transverse direction, whereas the lower leg consists of two tongues $11^{II}c_1$ and $11^{II}c_2$ arranged symmetrically with respect to the vertical longitudinal center plane of the front jaw $1^{II}$. Between the plate $11^{II}b$ and each tongue $11^{II}c_1$ or $11^{II}c_2$ there is arranged an axle $12^{II}a$ or $12^{II}b$ on each of which a toggle lever $13^{II}$ or $14^{II}$ is supported. The longer lever arm $13^{II}a$, $14^{II}a$ of each toggle lever $13^{II}$, $14^{II}$ has a substantially U-shaped cross section, with axles $15^{II}$–$18^{II}$ being arranged in the two legs thereof, on which axles rollers $19^{II}$–$22^{II}$ are supported.

When the ski boot is not inserted, the vertical beam $10^{II}$ rests with its lower area, under the influence of the pull rod $8^{II}$ loaded by the spring $4^{II}$, directly on the bearing part $11^{II}$ by means of the projection $11^{II}i$ and in its upper area on the shorter lever arms only the arm $14^{II}b$ is shown in the drawings. The bearing part $11^{II}$ is in this manner urged by means of its countersurfaces $11^{II}a_1$ and $11^{II}a_2$ against the two bearing surfaces $2^{II}b_1$ and $2^{II}b_2$ of the crosswall $2^{II}a$ of the housing $2^{II}$. Furthermore, the longer lever arms $13^{II}a$, $14^{II}a$ of the two toggle levers $13^{II}$, $14^{II}$ are urged toward the vertical longitudinal center plane of the front jaw $1^{II}$ (compare FIG. 15).

Figure 15:
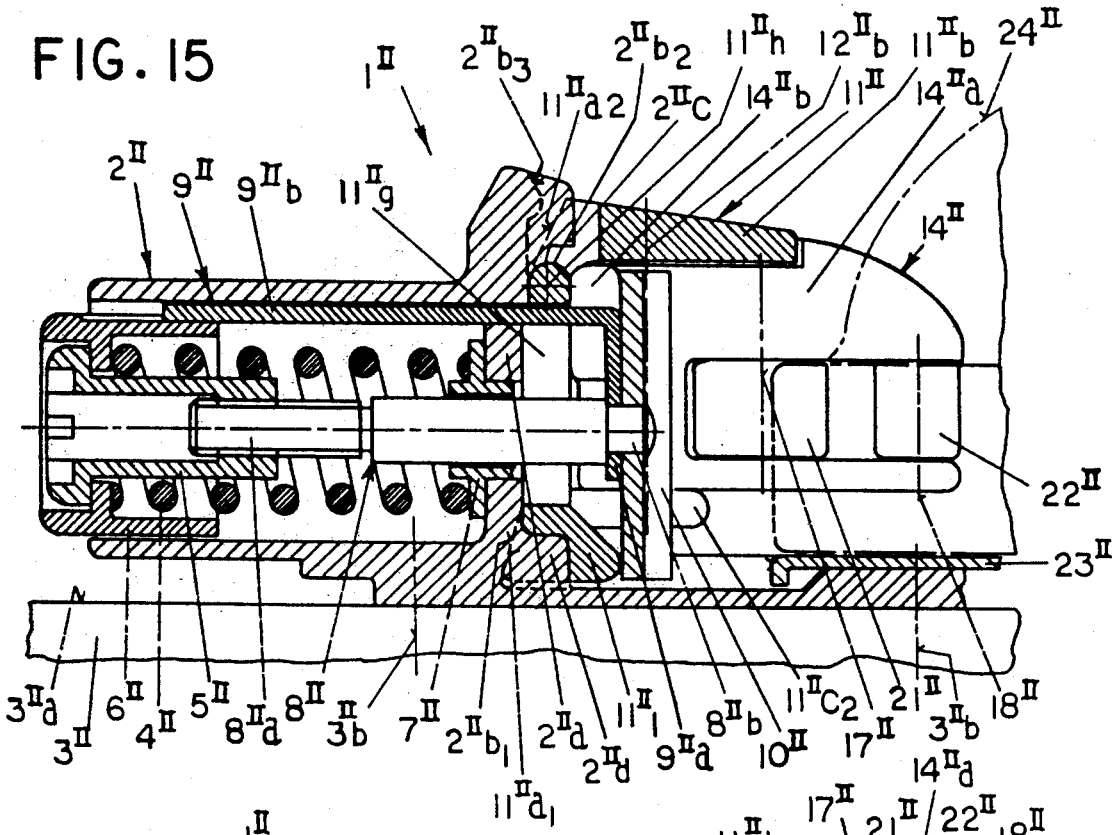
FIG. 15 is a central, vertical longitudinal cross-sectional view of a third embodiment of a front jaw in the skiing position.
Figure 16:
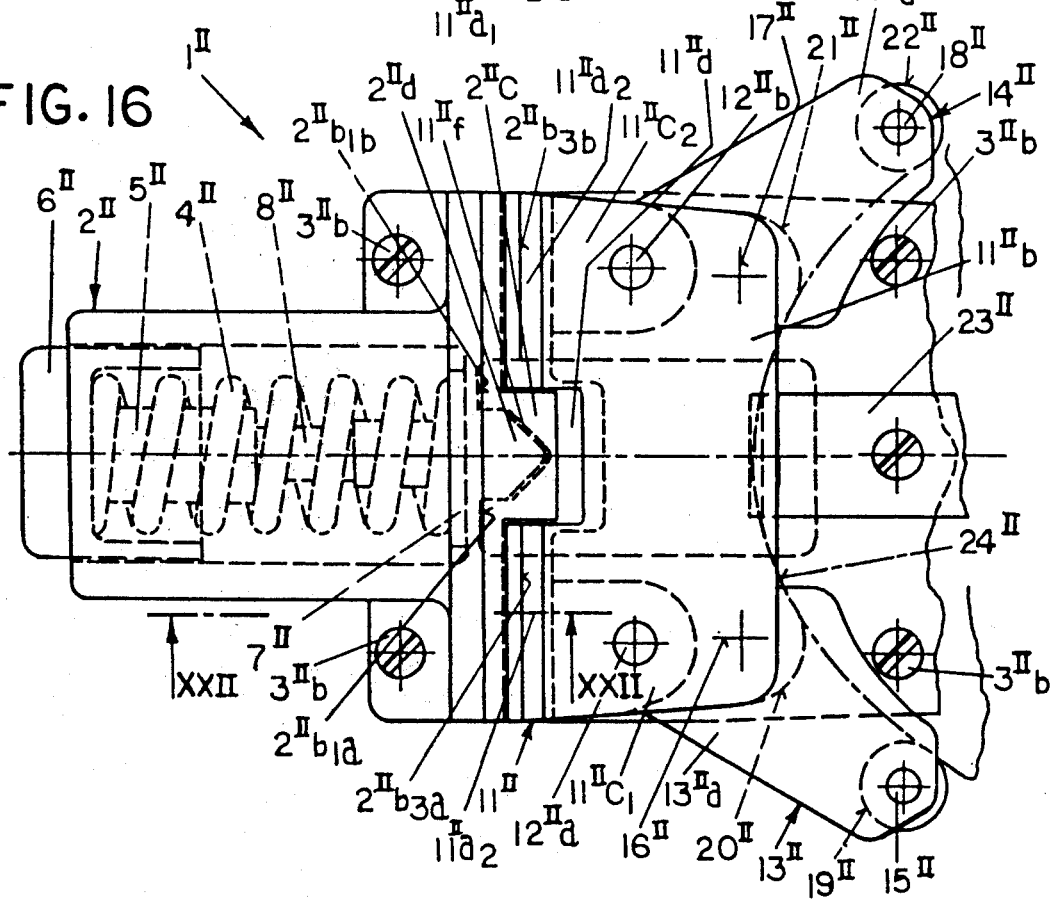
FIG. 16 is a top view thereof.
Figure 17:
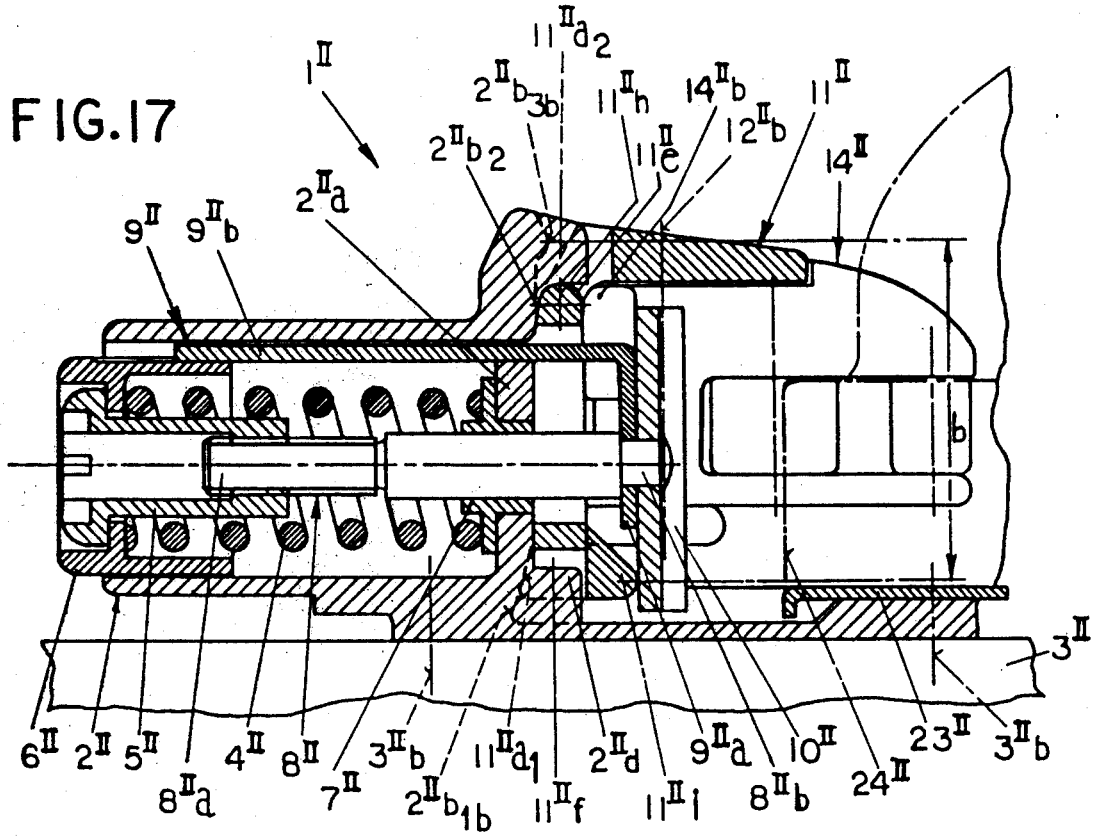
FIG. 17 shows this front jaw in the skiing position and with a ski boot having the greatest possible sole thickness being inserted.

If thereafter a ski boot $24^{II}$ with a thicker sole of a boot than that illustrated by dash-dotted lines in FIG. 15 is inserted into the front jaw $1^{II}$, then the bearing part $11^{II}$ slides along the two bearing surfaces $2^{II}b_1$ and $2^{II}b_2$ slightly upwardly. FIG. 17 shows the front jaw $1^{II}$ in a position in which a ski boot $24^{II}$, with the greatest possible thickness of the sole, is inserted into the front jaw $1^{II}$ (see also FIG. 22a). Thus, an automatic adjustment of the elevational position of the two toggle levers $13^{II}$, $14^{II}$ to the thickness of the respective sole of the ski boot occurs.

Figure 18:
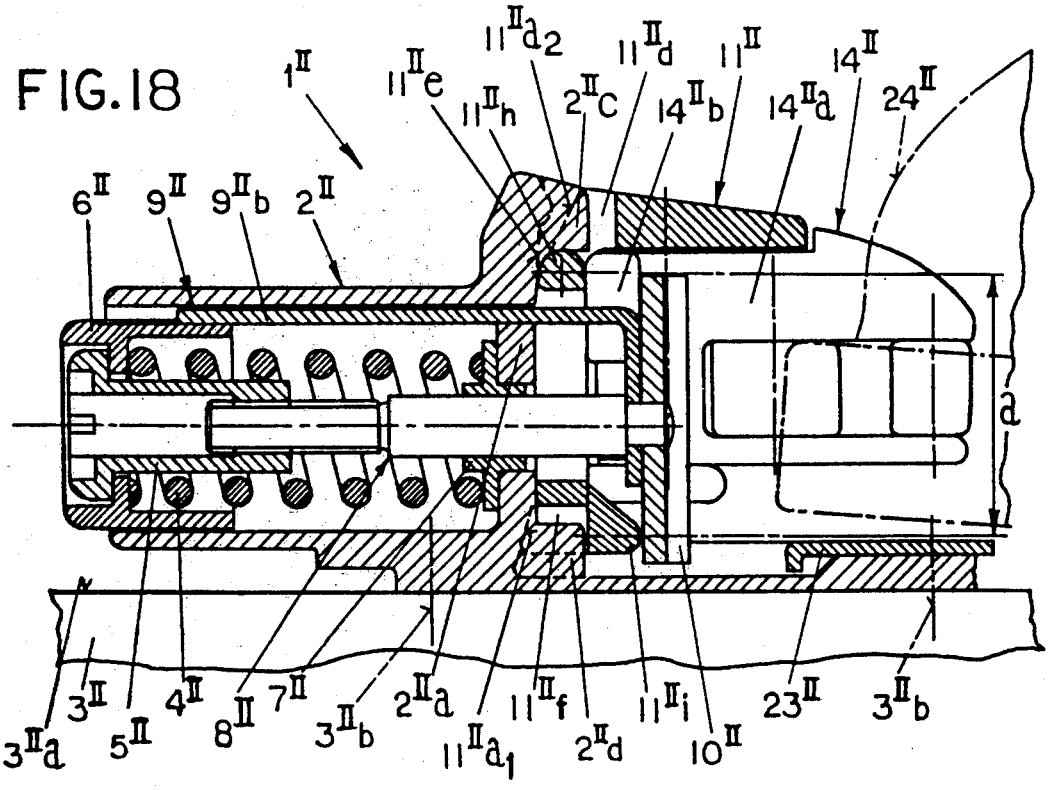
FIG. 18 shows this front jaw with a ski boot having a low sole of the boot during the start of a backward fall.

A similar position as in FIG. 17 is assumed by the bearing part $11^{II}$ when a ski boot $24^{II}$ with a low sole is inserted into the front jaw $1^{II}$ and a backward fall of the skier is started (compare FIG. 18). The bearing part $11^{II}$ slides also in this case along the two bearing surfaces $2^{II}b_1$ and $2^{II}b_2$ upwardly until its web $11^{II}h$ rests with the upper boundary surface $11^{II}e$ on the underside of the projection $2^{II}c$ of the housing $2^{II}$. The bearing part $11^{II}$ is thereafter pivoted counterclockwise. The release spring $4^{II}$ is more strongly initially tensioned, and the lower countersurface $11^{II}a_1$ of the bearing part $11^{II}$ is lifted off from the lower bearing surface $2^{II}b_1$ of the housing $2^{II}$ until the lower projection $2^{II}d$ has left the recess $11^{II}f$ in the bearing part $11^{II}$ and the countersurface $11^{II}a_2$ rests on the third bearing surface $2^{II}b_{3b}$ (see FIGS. 19 and 20). With this the first phase of the pivoting movement during a backward fall has been concluded.

If the bearing part $11^{II}$ is thereafter pivoted yet further during a backward fall (see FIGS. 20 and 22c), the countersurface $11^{II}a_2$ is lifted off from the bearing surface $2^{II}b_2$. However, the ideal pivot axis of the bearing part $11^{II}$ is thereby moved from the bearing surface $2^{II}b_2$ into the bearing surface $2^{II}b_{3b}$ $2^{II}b_3$, and the distance "a" between the line of contact of the projection $11^{II}i$ of the bearing part $11^{II}$ with the beam $10^{II}$, on the one hand, and the ideal transverse axis of the web $11^{II}h$ of the bearing part $11^{II}$, on the other hand, is increased to the distance "b" of the line of contact of the projection $11^{II}i$ of the bearing part $11^{II}$ with the beam $10^{II}$, on the one hand, and the line of contact of the support area of the third bearing surface $2^{II}b_{3b}$ with the countersurface $11^{II}a_2$ of the bearing part $11^{II}$, on the other hand, in the relationship of approximately 1:1.3. This has the result that the force needed for pivoting the bearing part $11^{II}$ and applied by the skier through the ski boot $24^{II}$ is increased (second phase of the pivoting movement during a backward fall). The second phase is limited by a stop $23^{II}$. As soon as the ski boot $24^{II}$ has come free from the front jaw $1^{II}$, the moment for the return of the bearing part $11^{II}$ into the initial position is therefore also increased compared with the moment at the start of the backward fall.

Figure 19:
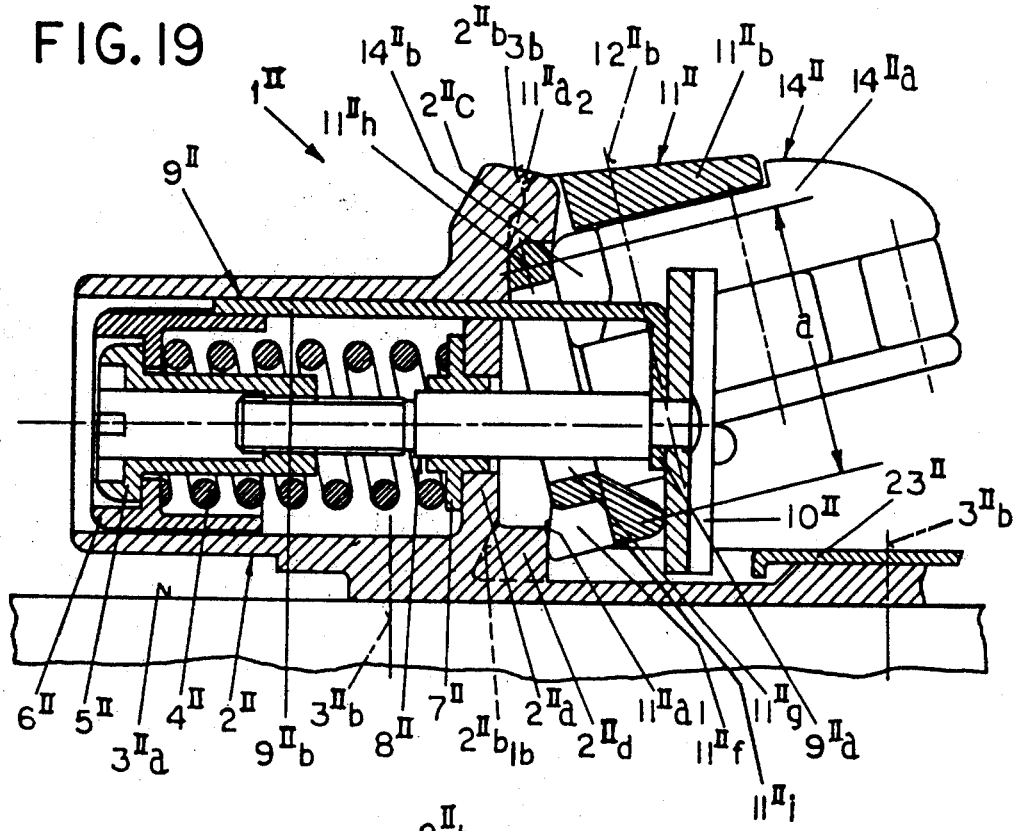
FIGS. 19 and 20 are also central, vertical longitudinal cross-sectional views of the front jaw during a backward fall of the skier, with FIG. 19 showing the first phase and FIG. 20 the second phase.
Figure 20:
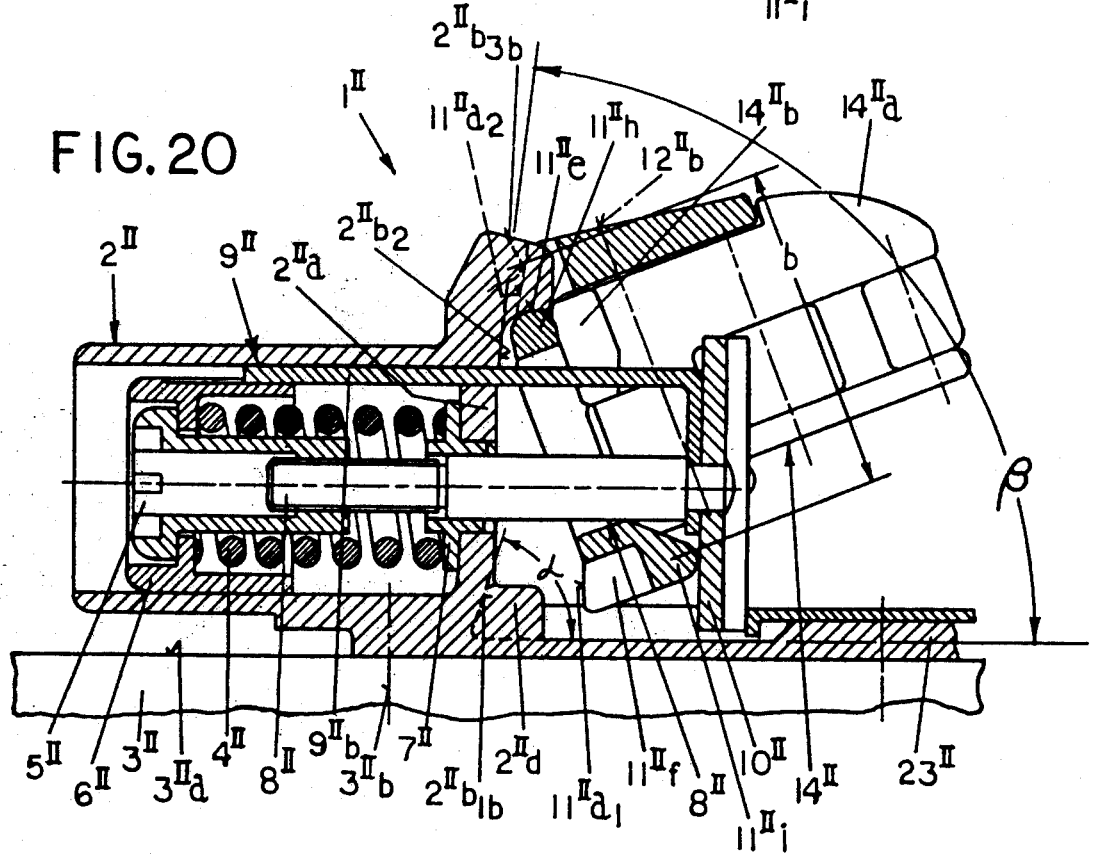
Figure 21:
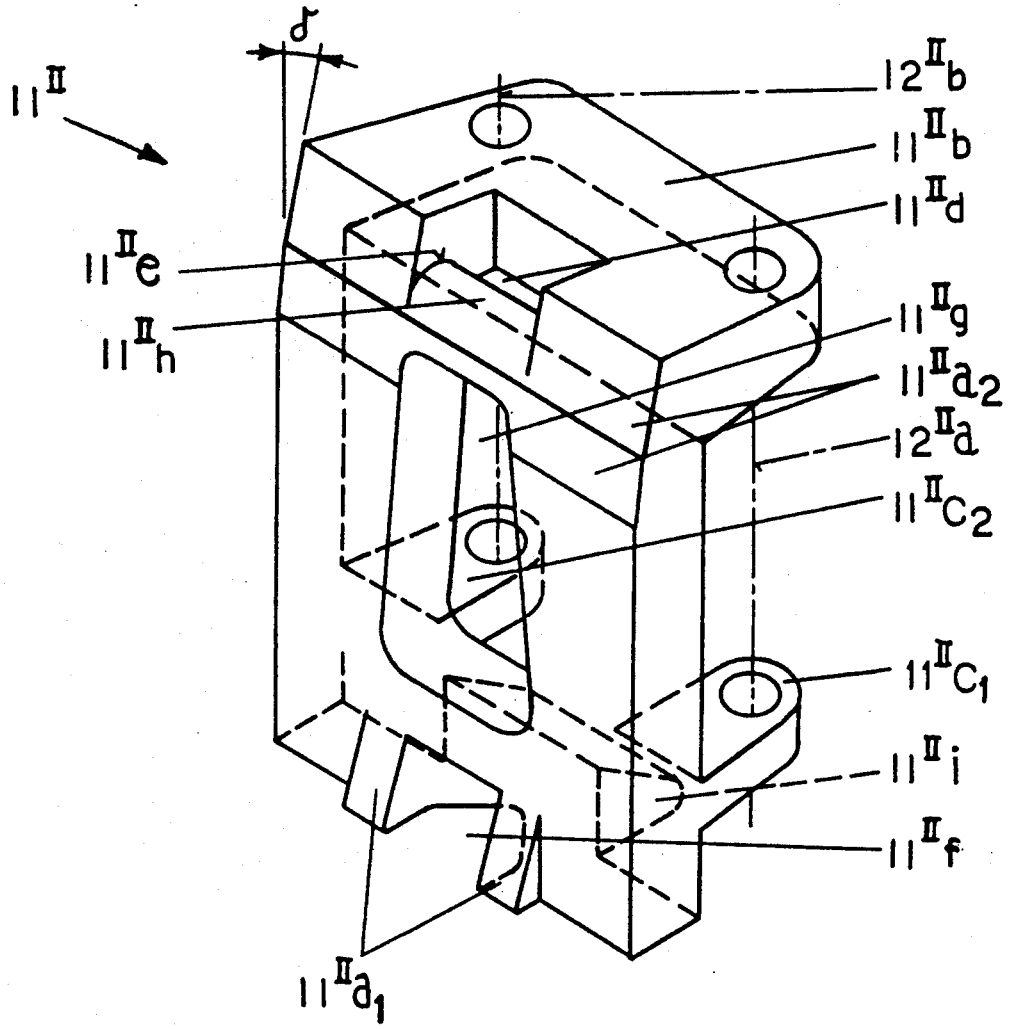
FIG. 21 is a perspective view of the bearing part of the front jaw.

If a backward fall of the skier occurs during skiing, then the bearing part $11^{II}$ is pivoted at least counterclockwise in FIGS. 19 and 20 until the lower projection $2^{II}d$ of the crosswall $2^{II}a$ of the housing $2^{II}$ has left the recess $11^{II}f$ in the bearing part $11^{II}$. The bearing part $11^{II}$ is thereafter rotated in a plane transverse to the longitudinal axis of the ski. This is made possible by the through opening $11^{II}g$ having ample clearance with respect to the pull rod $8^{II}$. The bearing part $11^{II}$ is during this pivotal movement pivotally supported by the upper projection $2^{II}c$ of the crosswall $2^{II}a$ of the housing $2^{II}$ received in the recess $11^{II}d$ of the bearing part $11^{II}$.

Since during a pivoting of the bearing part $11^{II}$ in a transverse plane, on the one hand, the pressure onto the two shorter lever arms of the two toggle levers $13^{II}$, $14^{II}$ is cancelled and, on the other hand, the bearing part $11^{II}$ and with it the corresponding toggle lever which can be swung out are lifted, the release of the ski boot from the front jaw $1^{II}$ is made easier during a backward twisting fall of the skier.

The following exemplary embodiments illustrate and describe only those details, which differ from the third exemplary embodiment.

The fourth embodiment of a front jaw $1^{III}$ illustrated in FIGS. 23–23c differs from the third one in providing, as a third bearing, a support area in the form of an edge $2^{III}b_{3a(b)}$ formed by the line of intersection of the crosswall $2^{III}a$ of the housing $2^{III}$ with the upper side. A bearing of the surface $11^{III}a_2$ on the associated front surface of the crosswall $2^{III}a$ takes place due to this measure in the first phase, and the distance "b", which in the third exemplary embodiment increases with an increasing angle of traverse of the bearing part $11^{III}$, is maintained constant for all values of the angle of traverse in the second phase.

A similar effect occurs in the fifth embodiment of a front jaw $1^{IV}$, as it is illustrated in FIGS. 24–24c. The edge $2^{IV}b_{3a(b)}$ is thereby formed by the crosswall $2^{IV}a$ and by a sloped surface $2^{IV}a$ which extends between the crosswall $2^{IV}e$ and the upper side of the housing $2^{IV}$.

The sixth embodiment of a front jaw $1^{V}$ illustrated in FIGS. 25–25c has the advantage that the third surface $2^{V}b_{3a(b)}$ is formed by a portion of a circular cylinder, and that the associated third countersurface $11^{V}a_3$ on the bearing part $11^{V}$ is formed by a groove, which is also defined by a circular cylinder surface. This solution has the advantage that the distance "b" does remain constant in the second phase during the pivoting operation, however, due to the size of the surface contact during the use of the front jaw $1^{V}$, practically no wear occurs.

FIG. 26 finally shows a seventh embodiment of a front jaw $1^{VI}$, in which the upper sides of housing $2^{VI}$ and bearing part $11^{VI}$ are curved convexly. This has the result that the third support area for the bearing part $11^{VI}$ is reduced to two points $2^{VI}b_{3a}$ and $2^{VI}b_{3b}$, which are connected by an ideal pivot axis or theoretical line L which extends in a vertical plane oriented perpendicular with respect to an axis of the pull rod.

The invention is not to be limited to the exemplary embodiments illustrated in the drawings and above described. Rather different modifications of the same are possible without departing from the scope of the invention. For example, the two toggle levers need not necessarily have a U-shaped cross section. Rather it would be conceivable to equip the bearing part with a separate sole down-holding means which could be formed by the plate from or on which the axles of the toggle levers are supported at their upper end. Furthermore, the intermediate piece between the housing and the bearing part does not need to be manufactured entirely of a low-friction material. Rather it is sufficient to provide this intermediate piece in its area resting on the bearing part with a layer of such a material. Finally, kinematic reversals of the constructions of the bearing part and of the crosswall also fall within the scope of protection of the invention.

The embodiments of the invention in which an exclusive property or privilege is claimed are defined as follows:

1. In a front jaw comprising a housing adapted to be fastened to a ski, a release spring housed in the housing, an elongated pull rod extending through the housing, the release spring being oriented to urge the pull rod along an axis thereof, the pull rod being operatively connected through a slide member guided in the housing to a shorter arm of a pair of two arm toggle levers, each pivotal about vertically upright axles, and a longer lever arm of each toggle lever engaging a front end of a sole or a ski boot, the improvement wherein a bearing part is provided for the toggle levers, wherein the housing has at least two bearing surfaces for the bearing part, the bearing surfaces being spaced vertically from one another and on opposite lateral sides of the pull rod, and wherein the vertically upright axles are supported on the bearing part, the bearing part having means defining a through opening therethrough through which the pull rod extends, wherein means are provided between the bearing part and the housing for allowing the bearing part to move freely vertically between defined limits on the housing in order to accommodate ski boots with varying sole thicknesses, wherein an upper one of the bearing surfaces is defined by a horizontal projection arranged symmetrically with respect to a central vertical longitudinal plane of the front jaw, wherein at least two of the bearings surfaces on the housing are both inclined at acute angles with respect to an upper side of the ski, a lower one of the angles being smaller than an upper one of the angles, wherein the projection is received in a recess in the bearing part, and wherein the projection defines an upper one of the limits for a path of movement of the bearing part in the vertical direction and, during a backward fall of a skier, a support for an upper boundary surface on the bearing part.

2. The front jaw according to claim 1, wherein respective countersurfaces are provided on the bearing part and are opposed to and are inclined at the same angles as said bearing surfaces.

3. The front jaw according to claim 2, wherein a vertically extending beam is fastened to the pull rod and engages both with an upper part thereof and also with a lower part of the bearing part so that the release spring will effect an urging of the countersurfaces on the bearing part against the associated bearing surfaces of the housing.

4. The front jaw according to claim 1, wherein in the center of a lower one of the bearing surfaces there is arranged a wedge-shaped projection, an outer boundary contour of which, viewed in a top view, is defined by a rectangle and an isosceles triangle, and wherein in the bearing part there is provided a recess conforming to the contour of the projection.

5. The front jaw according to claim 1, wherein the pull rod is provided with a cylindrical section at an end adjacent to the ski boot, the section being guided in a bearing sleeve which is secured in a crosswall of the housing.

6. The front jaw according to claim 3, wherein the beam includes a tongue received in a longitudinal groove of a base of the housing.

7. The front jaw according to claim 1, wherein between the housing and the bearing part there is arranged an intermediate piece which is manufactured of a low-friction material.

8. The front jaw according to claim 7, wherein the housing has a rib and wherein the intermediate piece has a hook which is secured to the rib, the intermediate piece including a bent section conforming in shape to an upper part of the housing.

9. The front jaw according to claim 1, wherein on the housing vertically above one of said bearing surfaces there is provided a support area defining a third bearing surface, the support area extending transversely with respect to the pull rod, wherein the bearing part is arranged pivotally relative to the housing, and wherein the pivoting movement of the bearing part includes two phases, a first phase being when the bearing part is pivotal about an ideal transverse axis of a web part thereof and a second phase being when the bearing part is pivotal about a transverse axis defined by the third bearing surface.

10. The front jaw according to claim 9, wherein a vertically extending beam is fastened to the pull rod and engages both with an upper part thereof and also with a lower part thereof the bearing part so that the release spring will effect an urging of the countersurfaces on the bearing part against the associated bearing surfaces of the housing, and wherein the bearing part has in a lower end area a rearwardly directed projection defining a bearing abutment for a beam fastened on the pull rod.

11. The front jaw according to claim 9, wherein the third bearing surface consists of two sections provided on both sides of a central vertical longitudinal plane of the front jaw and includes means defining a projection between the two sections, the projection extending into a recess in the bearing part.

12. The front jaw according to claim 9, wherein the third bearing surface, viewed in a longitudinal cross-sectional view of the front jaw, is arch-shaped, the bearing part being supported in the second phase of a pivotal movement thereof in various pivoted positions along a line of contact which extends in transverse direction with respect to the pull rod.

13. The front jaw according to claim 9, wherein a countersurface on the bearing part opposing the third bearing surface is flat.

14. The front jaw according to claim 9, wherein the third bearing surface is defined by an edge formed by a line of intersection of a crosswall on the housing and an upper side of the housing.

15. The front jaw according to claim 9, wherein said housing has a crosswall, and wherein the crosswall has a forwardly directed slope, an edge defined between the crosswall and the slope forming the third bearing surface.

16. The front jaw according to claim 9, wherein an upper side of the housing, viewed in a direction of the pull rod, is convexly curved, and wherein the third bearing surface is formed by two points on the curve connected by a theoretical line, said line extending in a vertical plane perpendicular with respect to an axis of the pull rod.

17. The front jaw according to claim 9, wherein the third bearing surface, viewed in a longitudinal cross section of the front jaw, is circularly curved, and wherein an opposing surface of the bearing part in a section associated with the third bearing surface is correspondingly curved.

18. The front jaw according to claim 10, wherein the distance between a line of contact of the projection on the bearing part with the beam and the ideal transverse axis of the web of the bearing part has a relationship of approximately 1:1.3 with respect to the distance between a line of contact of the projection on the bearing part with the beam and a line of contact between the third bearing surface and the opposing surface on the bearing part.

19. The front jaw according to claim 9, wherein the bearing part rests on the third bearing surface only when an engagement between a lower projection of the housing and the recess of the bearing part has been terminated.

20. The front jaw according to claim 10, wherein a stop fastened on the housing is operatively engageable with the beam, the stop limiting an angle of traverse of the bearing part.

21. The front jaw according to claim 7, wherein said material is DELRIN.

* * * * *

UNITED STATES PATENT AND TRADEMARK OFFICE

CERTIFICATE OF CORRECTION

PATENT NO. : 5 193 841

DATED : March 16, 1993

INVENTOR(S) : Karl STRITZL et al

It is certified that error appears in the above-identified patent and that said Letters Patent is hereby corrected as shown below:

On the title page, item [30] and in Column 1, Foreign Application Priority Data, change "Australia" (both occurrences) to ---Austria---.

Column 9, line 24; change "or" to ---of---.

Column 9, line 40; change "bearings" to ---bearing---.

Signed and Sealed this

Eleventh Day of January, 1994

*Attest:*

*Attesting Officer*

BRUCE LEHMAN

*Commissioner of Patents and Trademarks*